US005080560A

United States Patent [19]

LeRoy et al.

[11] Patent Number: 5,080,560

[45] Date of Patent: Jan. 14, 1992

[54] DRYRITE BOREHOLE DEWATERING SYSTEM

[76] Inventors: Jack W. LeRoy; Nadine Mayer, both of 3839 Crater Lake Hwy., Medford, Oreg. 97501

[21] Appl. No.: 482,238

[22] Filed: Feb. 20, 1990

[51] Int. Cl.[5] ..... F04F 5/46

[52] U.S. Cl. ..... 417/172; 417/179; 417/181

[58] Field of Search ..... 417/172, 179, 181, 108, 417/90

[56] References Cited

U.S. PATENT DOCUMENTS

| | | | |
|---|---|---|---|
| 487,639 | 12/1892 | Phole | 417/108 |
| 1,038,201 | 9/1912 | Rateau | 417/80 |
| 1,967,231 | 7/1934 | Engstrand et al. | 417/90 |
| 2,909,127 | 10/1959 | Bradaska | 417/172 |
| 3,672,790 | 6/1972 | White et al. | 417/108 |
| 3,788,771 | 1/1974 | Akins, Sr. | 417/88 |
| 4,037,991 | 7/1977 | Taylor | 417/80 |
| 4,083,660 | 4/1978 | Newbrough | 417/172 |
| 4,166,485 | 9/1979 | Wokas | 285/345 X |
| 4,171,106 | 10/1979 | Kempton | 417/172 |
| 4,400,138 | 8/1983 | Baer | 417/181 |
| 4,505,646 | 3/1985 | Long et al. | 417/172 |
| 4,790,376 | 12/1988 | Weeks | 417/172 |

*Primary Examiner*—Leonard E. Smith

*Attorney, Agent, or Firm*—Klarquist, Sparkman, Campbell, Leigh & Whinston

[57] ABSTRACT

Apparatus for extracting water comprises an air compressor, a diaphragm type suction pump, a jet pump for insertion into a borehole and a suction line connecting the jet pump to the diaphragm pump. Air to accelerate water through the jet pump and into the suction hose is supplied through an air line disposed internally of said suction hose.

4 Claims, 1 Drawing Sheet

DRYRITE BOREHOLE DEWATERING SYSTEM

FIELD OF INVENTION

This invention relates to a suction pump for extracting fluid from downhole applications, specifically for dewatering small to large diameter boreholes.

BACKGROUND-DESCRIPTION OF PRIOR ART

The explosives industry makes extensive use of boreholes for blasting in a multitude of applications. In the course of preparing a pattern or series of explosives charges, boreholes are drilled which, on occasions, will fill with water over a period of time due to groundwater migration and other contributing factors. In many types of explosives applications, it is desirable to pump out the water prior to loading the explosives. One of the most cost effective explosives used in the industry is ammonium nitrate (ANFO) and/or water resistant ANFO. The use of ANFO and/or WR ANFO requires the complete dewatering of the borehole prior to being loaded.

In addition, mud and drill cuttings frequently wash into the boreholes from the surface filling a portion of the borehole. Pump systems available to the industry to date are not capable of removing the accumulated mud and drill cuttings without sustaining excessive wear and damage.

Borehole diameter and depths vary according to the application. Borehole diameters range from one inch to over twenty four inches, and are drilled to depths exceeding one hundred feet.

To date, inventors have created several pump systems to dewater boreholes. U.S. Pat. No. 3,788,771 to Atkins (1974) utilizes a submersible rotating air motor for driving a vane type pump. The diameter of this type of pump excludes it from being used in borehole diameters smaller than about four inches. In addition, by the nature of the vane pumping system, wear on the vanes is accelerated due to suspended drill cuttings in the water resulting in loss of efficiency and high operation costs. Also, the inlet and outlet air lines are positioned on the outside of the pump and discharge hose. The irregular outside surface of the pump could cause the pump to hangup on rocks protruding from the borehole wall resulting in wedging the pump in the hole. When this occurs, the pump could be unretrievable and lost. Finally, the pump system by design, is not capable of pumping the accumulations of mud and drill cuttings that frequently accumulate in the bottom of the borehole. Thus, the hole cannot be loaded with explosives to its full drilled depth.

Another method utilizing air as the primary driving source for lifting water from a deep hole or well is shown in U.S. Pat. No. 487,639 to Pohle (1892). This method pressurizes air that is delivered to the bottom of an eduction pipe positioned in the well thereby displacing the head pressure and driving the fluid out. Thereafter, air flow is continued at pressure such that air bubbles are forced to, in effect, act as pistons to lift short columns of water to the top of the pipe. Again, by virtue of size and exterior plumbing, this method is not suitable for repeated lowering and retrieving in boreholes of small size. In addition, the flow rate of this method lacks the flow performance to be economically useful and does not have the ability to transfer water away from the blasting area.

The jet pump method is used in two other U.S. patents. Both units utilize a venturi effect to enhance the desired result. Firstly, U.S. Pat. No. 4,037,991 to Taylor utilizes the Coanda effect to minimize the risk of separation or vapor and/or dissolved gasses from a pumped liquid fuel resulting from low pressure intake to the pump. The pumping and pumped liquid in this instance are of the same composition. This method was developed to transfer jet fuels and does not have an application in dewatering boreholes. And secondly, U.S. Pat. No. 1,038,201 to Rateau (1912) utilizes a fluid recirculating loop applied to an injector fluid flow assist. Since a portion of the fluid must be recirculated at high pressure by a centrifugal jet pump located on the surface, it is not capable of handling solids in the fluid. Also, this system does not self prime. Each time the pump is installed in a borehole, it would have to be primed rendering it unfeasible for borehole dewatering. All of the heretofore inventions suffer from a number of disadvantages for dewatering boreholes for blasting inasmuch as they lack the following requirements:

(A) Pump systems must be able to be inserted into boreholes as small as one and one half inches and easily retrieved with short cycle time to allow immediate loading of explosives before ground water seeps back into the borehole.

(B) The portion of the pump that is inserted into the borehole must be regular in shape so as not to hang-up or wedge itself in the borehole.

(C) The pump system must provide a method for dislodging a pump that becomes wedged or lodged in a borehole so as to enable its retrieval.

(D) Pump systems must be capable of pumping abrasive drill cuttings and mud slurry.

(E) Discharge fluids from the boreholes must be pumped off site to prevent the fluid from migrating back into the boreholes from the surface.

OBJECTS AND ADVANTAGES

Accordingly, the objects and advantages of my patent invention are:

(a) To provide a lightweight portable unit that can easily be moved by hand from borehole to borehole.

(b) To provide a system that will pump liquid, drill cuttings, and mud slurries from small as well as large diameter boreholes to permit loading explosives to the full drilled depth. In addition, to provide a pump that can pump the abrasive drill cuttings and mud slurries without causing accelerated or undue wear on the pump system.

(c) To provide a flexible suction hose portion of the pump that is slim in nature with a relatively smooth outer surface void of any exterior plumbing fixtures.

(d) To provide a pump system that will self prime in a short period of time.

(e) To provide a pump that will pump fluid from a depth of one hundred feet and greater.

(f) To provide a pump that has a reliable means of reversing flow to the suction hose to dislodge materials should the suction hose become wedged in the borehole.

(g) To provide a pump system with a lightweight, flexible suction hose that can be fed into fractured and irregular boreholes, manipulated and retrieved by hand.

(h) To provide a system that will extract the fluid from the suction hose when the borehole is completely dewatered to provide for lifting an empty suction hose from the borehole.

(i) To provide a pump system that is constructed of non-sparking materials that will withstand exposure to the outdoor construction environment as well as incidental contact with corrosive explosives such as ammonium nitrates.

Further objects and advantages are to provide a highly durable pumping unit, using a high quality anodized aluminum body jet pump and a suction line that is easily handled in and out of the borehole with no additional lines on the exterior to hang-up. Still further objects and advantages will become apparent from a consideration of the ensuing description and drawings.

DRAWINGS

DETAILED DESCRIPTION

Figure 1:
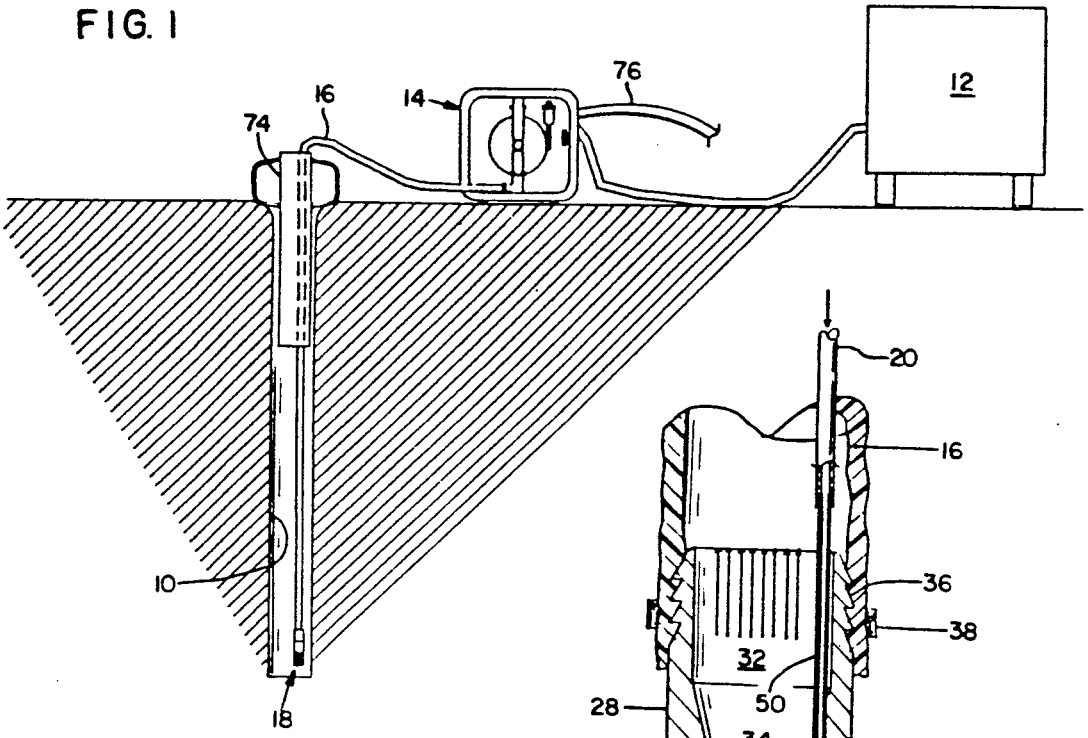
FIG. 1 is a schematic view of a borehole system constructed in accordance with the invention.

Referring first to FIG. 1, illustrated is a system in accordance with the invention for extracting water from a borehole 10. The system includes an air compressor 12, an air driven suction pump 14 from which extends a suction hose 16 which extends into the borehole and to the end of which is attached the upper outlet end of a jet pump 18. The air compressor is connected to a hose 20 (FIG. 2) which is threaded through the suction hose 16 and connected to the jet pump 18 is a manner to be explained below.

The air compressor 12 may be any commercially available type capable of supplying air to the jet pump 18 at a pressure greater than that of a column of water the height of the borehole depth.

The suction pump 14 preferably is a reversible, neoprene diaphragm positive displacement type and may be any suitable commercially available pump of that type but preferably one capable of discharging water away from the borehole with up to 75 foot of head pressure. I found a Weldon model M-8 pump modified to reduce the annular space in the fluid chamber to increase the suction to 21 inch of mercury with pump dry increased the pumping volume.

The suction hose 16 should be capable of resisting collapse from external air pressure during extraction of water from a borehole. It has been found that smooth exterior surfaced plastic hose with a spiral wound nylon core sold by Kanaflex Corporation of California under the designation Series 110/112 is suitable.

Figure 2:
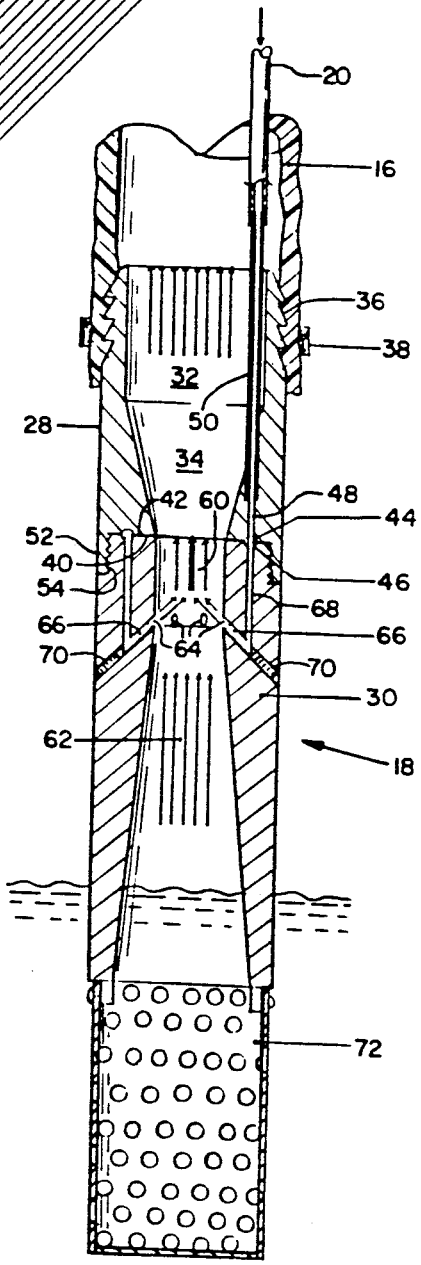
FIG. 2 is an enlarged longitudinal sectional view of a jet nozzle constructed in accordance with the invention.

Referring now to FIG. 2, the jet pump 18 comprises a two piece generally tubular body 26 of substantially uniform outer diameter including an upper body portion 28 and a lower body portion 30. The body 26 is preferably formed of a non-spark generating material such as brass or aluminum, the latter being preferred.

The upper body portion 28 includes an exit portion 32 of substantially uniform inner diameter which merges with an expansion portion 34 at its lower end, the inner surface of which expansion portion converges from the exit portion 32 to the lower end thereof. The upper end of the body portion 28 is formed with conventional hose gripping rings 36 and is clamped within the end of the suction hose 16 by a clamp ring 38. The body portion 28 has a planar lower face 40 which mates with a planar upper face 42 of the lower body portion 30. Milled in each of such faces in mating relation are circular air distribution grooves 44, 46. It will be apparent a single groove in one of the faces could be provided. A passageway 48 is drilled from the groove 44 in the upper body portion 28 into the interior of the body portion 28 and into which passageway is suitably secured a tube 50 adapted to be connected to the lower end of the compressed air hose 20. The upper and lower body portions 28, 30 are suitably clamped together. In the illustrated embodiment the lower body portion 30 has an internally threaded annular projection 52 that is received within a cooperatively threaded peripheral groove 54 in the lower end of the upper body portion 28.

The lower body portion 30 comprises a venturi nozzle and includes a throat portion 60 that mates with the expansion portion 34 and a converging inlet portion 62. A plurality of air injection ports 64 are provided for injecting air at an upwardly inclined angle into the throat 60 adjacent its juncture with the inlet portion 62. The ports 64 may be formed by drilling passageways 66 angularly inwardly at an angle of about 25 degrees from the vertical from the exterior surface of body portion 30 through the wall of the throat 60 so as to intersect vertical passageways 68 drilled downwardly from the groove 46. The portion 70 of a passageway 66 between the outer surface and a vertical passageway 68 may be plugged in any suitable manner. If the diameter of the throat 60 permits the passageways 66 may be drilled from the interior surface of the throat to the vertical passageways 68. In a 1½" exterior diameter jet pump I have found two ports to be adequate, but only one or more than two could be utilized.

Suitably attached to the lower end of the lower body portion 30 is a tubular inlet screen 72 formed of aluminum, brass or other non-sparking material, the screen and the fasteners therefor preferably being within the projection of the surface of the body 26 so as minimize hang-up problems when the pump is pulled from a borehole.

OPERATION

To dewater a borehole 10 the air compressor 10 and suction pump 14 are positioned suitably near the bore hole and the suction hose 16, air hose 20 and jet pump connected together. The jet pump 18 and suction hose are then threaded into the borehole into the upper portion of which a sleeve 74 may be positioned to help avoid knocking debris into the borehole during insertion of the pump 18. When the pump 18 reaches the bottom of the borehole 10 the compressor 12 and suction pump 14 are started. The water in the borehole is elevated to the surface through a combination of forces. The compressed air ejected from the ports 64 propels the water in the throat upwardly through an energy exchange. The venturi configuration of the body portion also creates a low pressure condition in the throat so that water in the lower portion of the body is forced upwardly towards the throat by the atmospheric pressure on the surrounding water. The suction pump serves to "suck" and accelerate the movement of water upwardly through the hose, the mixing of the injected air with the water column in the hose in effect reducing the specific gravity of the column to increase the effective head height to which the water may be lifted. With a jet pump body 26 having an exterior diameter of only 1½ inch and with an air pressure of 150 psi at the outlet of the air compressor it has been possible to lift water from a borehole in excess of 100 feet in depth. Water is discharged to some remote location through a hose 76.

The system described has a number of further advantages. It is lightweight and easily moved by hand. It can be used effectively in boreholes of small diameter, i.e., just slightly larger than the hose diameter, and in irregular or crooked boreholes. Drill cuttings and mud slurries extracted from the borehole will not cause excessive wear. Also the system is self-priming and if the suction base 20 or jet pump 26 become plugged, the suction pump 14 can be reversed to reverse the air flow which will usually be effective to remove the obstruction. Most importantly, boreholes can be dewatered at a high discharge flow rate with resulting economies in time of personnel and equipment.

Having illustrated and described a preferred embodiment of the invention, it should be apparent the invention can be modified in arrangement and detail. I claim all such modifications as fall within the purview of the appended claims.

I claim:

1. Apparatus for extracting water from a borehole comprising:

an air compressor, a diaphragm type suction pump, a jet pump having a smooth, cylindrical exterior surface for insertion into the borehole, a suction hose connecting said suction pump to said jet pump, and air line communicating with said air compressor and said jet pump to supply air to the jet pump, said air line being disposed internally of said suction hose and connected to one end of said jet pump within the confines of said exterior surface, said jet pump comprising a tubular body having an upper portion and a lower portion having substantially planar mating faces, the interior surfaces of said upper and lower body portions being configured to define a venturi having a constricted throat portion in the upper part of said lower body portion, a conveying inlet portion in the lower part thereof and a diverging exit portion in said upper body portion, said mating faces defining an air distribution passageway therebetween, a plurality of upwardly angled air ports formed in said lower body portion for projecting air jets angularly upwardly into said constricted throat portion, passageway means communicating between said air distribution passageway and said ports for conveying air to said ports, an infeed passageway extending from said air distribution passageway into said diverging exit portion to provide a pathway for the passage of air into said air distribution passageway and thence into said ports, and means for connecting said airline to said infeed passageway.

2. A jet pump for extracting water from a borehole or the like comprising:

a tubular body having an upper portion and a lower portion having substantially planar mating faces, the interior surfaces of said upper and lower body portions being configured to define a venturi having a constricted throat portion in the upper part of said lower body portion, a converging inlet portion in the lower part thereof and a diverging exit portion in said upper body portion, said mating faces defining an air distribution passageway therebetween, a plurality of upwardly angled air ports formed in said lower body portion for projecting air jets angularly upwardly into said constricted throat portion, passageway means communicating between said air distribution passageway and said ports for conveying air to said ports, and an infeed passageway extending from said air distribution passageway into said diverging exit portion to provide a pathway for the passage of air into said air distribution passageway and thence into said ports.

3. A jet pump as set forth in claim 2 wherein said tubular body is formed of a non-sparking metal.

4. A jet pump as set forth in claim 2 wherein said tubular body is formed of aluminum.

* * * * *

UNITED STATES PATENT AND TRADEMARK OFFICE

CERTIFICATE OF CORRECTION

PATENT NO. : 5,080,560

DATED : January 14, 1992

INVENTOR(S) : Jack W. LeRoy

It is certified that error appears in the above-identified patent and that said Letters Patent is hereby corrected as shown below:

Title page:

"[54] DRYRITE BOREHOLE DEWATERING SYSTEM" should be --[54] BOREHOLE DEWATERING SYSTEM--;

"[54] Inventors: Jack W. LeRoy; Nadine Mayer, both of 3839 Crater Lake Hwy., Medford, Oreg. 97501" should be --[54] Inventors: Jack W. LeRoy of 3839 Crater Lake Hwy., Medford, Oreg. 97501--; and Column 1, line 1, "DRYRITE BOREHOLE DEWATERING SYSTEM" should be --BOREHOLE DEWATERING SYSTEM--.

Signed and Sealed this

Fifteenth Day of June, 1993

Attest:

Michael K. Kirk

MICHAEL K. KIRK

Attesting Officer

Acting Commissioner of Patents and Trademarks